US006213419B1

(12) United States Patent
Fritzson

(10) Patent No.: US 6,213,419 B1
(45) Date of Patent: Apr. 10, 2001

(54) ELASTIC ANTI-BALLOONING BAND ON A YARN FEEDER

(75) Inventor: Joachim Fritzson, Ulricehamn (SE)

(73) Assignee: Iro AB, Ulricehamn (SE)

( * ) Notice: Subject to any disclaimer, the term of this patent is extended or adjusted under 35 U.S.C. 154(b) by 0 days.

(21) Appl. No.: 09/155,528

(22) PCT Filed: Mar. 25, 1997

(86) PCT No.: PCT/EP97/01522

§ 371 Date: Feb. 22, 1999

§ 102(e) Date: Feb. 22, 1999

(87) PCT Pub. No.: WO97/36817

PCT Pub. Date: Oct. 9, 1997

(30) Foreign Application Priority Data

Mar. 29, 1996 (DE) ..... 196 12 720

(51) Int. Cl.[7] ..... B65H 51/20
(52) U.S. Cl. ..... 242/365.4; 139/452
(58) Field of Search ..... 242/365.4, 365.1, 242/128, 364; 139/452

(56) References Cited

U.S. PATENT DOCUMENTS

| | | | | |
|---|---|---|---|---|
| 4,037,802 | * | 7/1977 | Calamani et al. | 242/365.4 X |
| 4,785,855 | | 11/1988 | Benz et al. . | |
| 4,926,912 | | 5/1990 | Zenoni . | |
| 5,181,666 | * | 1/1993 | Bitzer | 242/365.1 |
| 5,316,051 | * | 5/1994 | Zenoni et al. . | |
| 5,582,214 | | 12/1996 | Sarfati . | |
| 5,738,291 | * | 4/1998 | Tholander | 242/365.4 |
| 5,778,943 | * | 7/1998 | Tholander | 242/365.4 X |
| 5,979,815 | * | 11/1999 | Svanstroem et al. | 242/365.4 X |

FOREIGN PATENT DOCUMENTS

| | | |
|---|---|---|
| 669 804 | 4/1989 | (CH) . |
| 1 760 658 | 2/1972 | (DE) . |
| 25 55 802 | 6/1977 | (DE) . |
| 94 06 102 | 9/1995 | (DE) . |
| 0 680 917 | 11/1995 | (EP) . |
| 1 355 518 | 6/1974 | (GB) . |
| WO 95/28348 | 10/1995 | (WO) . |

OTHER PUBLICATIONS

Patent Abstracts of Japan, Publication No. 59143867, Publication Date Aug. 17, 1984, Inventor Tagawa Naoji, and entitled Weft Stagnating Device of Shuttleless Loom.

* cited by examiner

*Primary Examiner*—Donald P. Walsh
*Assistant Examiner*—Collin A. Webb
(74) *Attorney, Agent, or Firm*—Flynn, Thiel, Boutell & Tanis, P.C.

(57) ABSTRACT

A yarn feeder having a stationary storage drum defining at least one cylindrical and circumferentially closed circumferential section, and a stationarily held ring-shaped yarn control element surrounding the circumferential section. The yarn control element is a finite band having a generally planar cross-section and is positioned on the circumferential section with mutually aligned, neighboring ends. The band is resistant against extension in the circumferential direction and is yieldable in the radial direction of the storage drum. Further, the band is preloaded against the circumferential section by means of an elastic tensioning device.

20 Claims, 2 Drawing Sheets

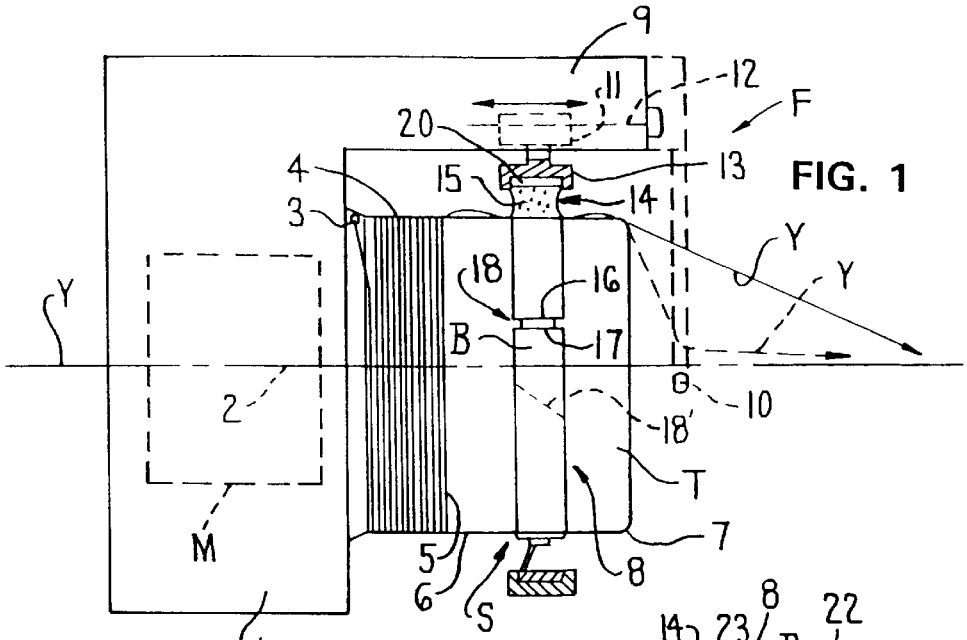
FIG. 1
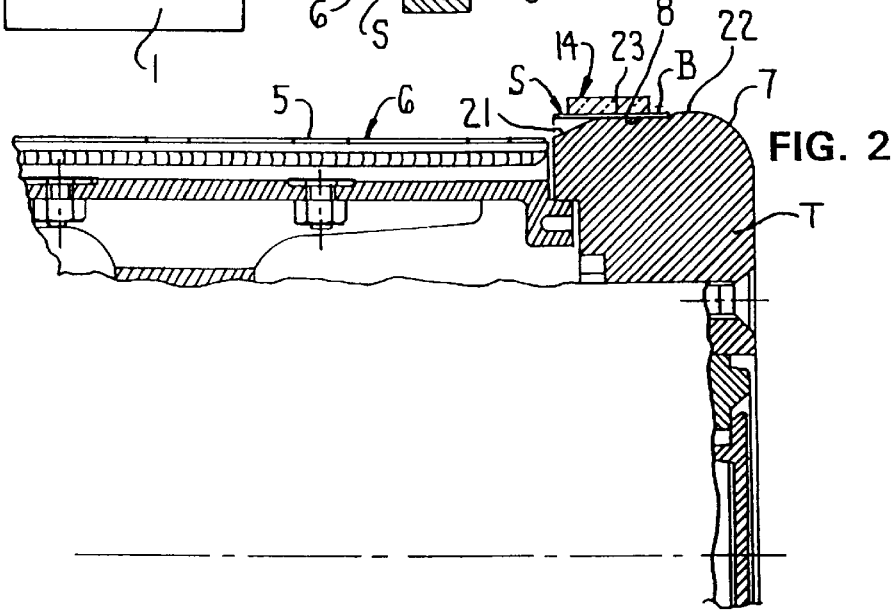
FIG. 2
FIG. 3
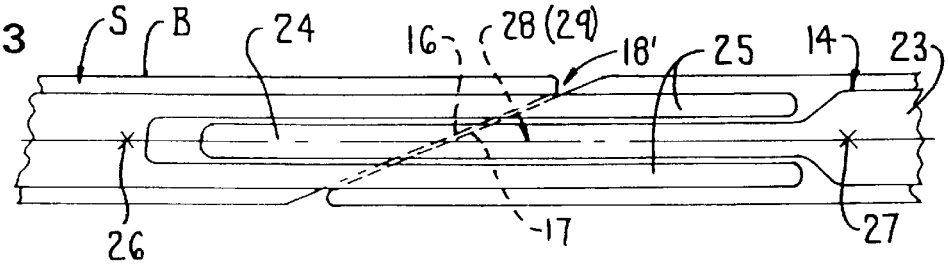
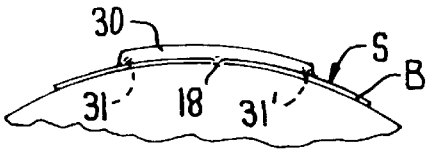
FIG. 4
FIG. 1A
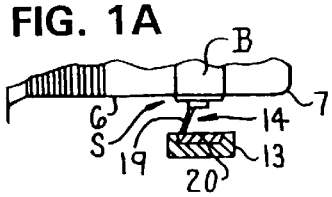

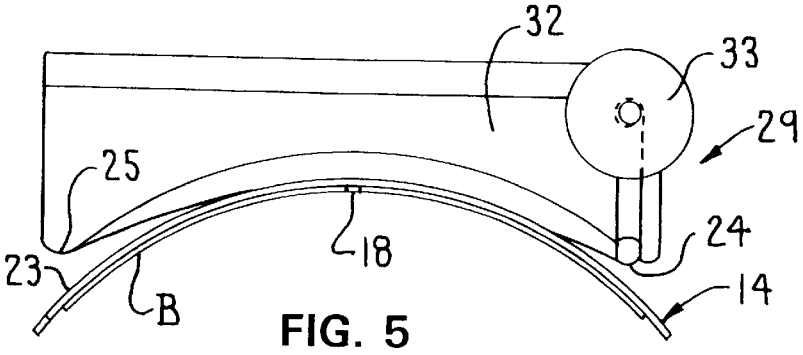
FIG. 5
FIG. 6A
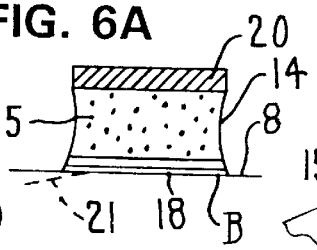
FIG. 6B
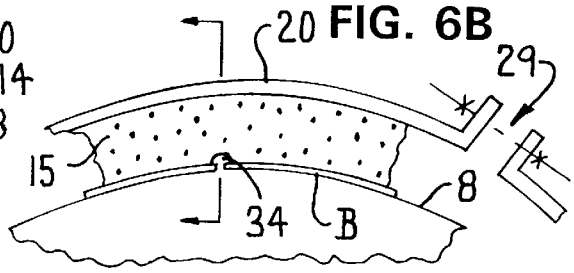
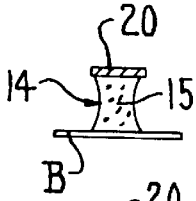
FIG. 7
FIG 6C
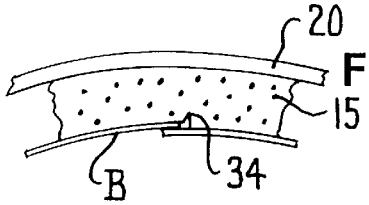
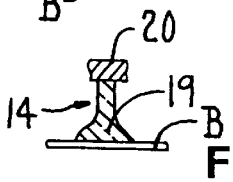
FIG. 8
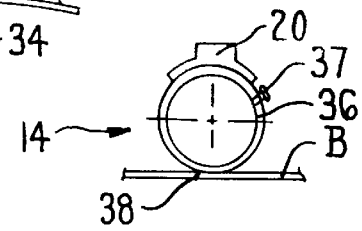
FIG. 11
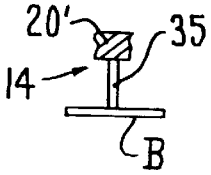
FIG. 9
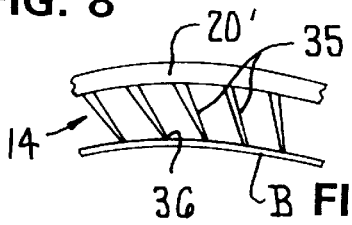
FIG. 10
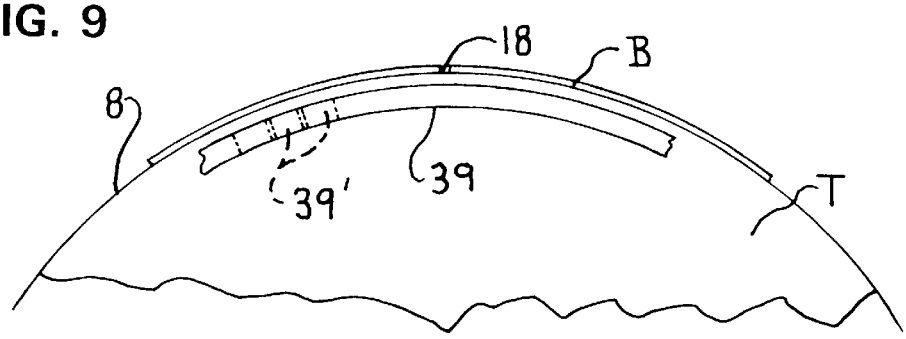
FIG. 12

ELASTIC ANTI-BALLOONING BAND ON A YARN FEEDER

FIELD OF THE INVENTION

The present invention relates to a yarn feeder including a housing for a drive motor and a drive shaft, a yarn winding on element which rotates with the drive shaft, a stationary storage drum having a cylindrical, circumferentially closed section, and a stationarily held ring-shaped yarn control element surrounding the circumferential section between a yarn store section and a yarn withdrawal section of the storage drum.

BACKGROUND OF THE INVENTION

In a yarn feeder as known from GB-C-1355518 (FIG. 9) the yarn control element is formed as a stable hollow body supported separately from the storage drum and put over the withdrawal end at the front side of the storage drum. The yarn control element surrounds the cylindrical circumferential section of the storage drum with radial distance by its big diameter cylindrical end portion. In this case the yarn control element minimizes the formation of a balloon during withdrawal of the yarn from the yarn store on the storage drum overhead of the withdrawal region into a withdrawal eyelet positioned in front of and co-axially relative to the storage drum. Among other influences the yarn orbiting around the withdrawal region due to centrifugal force tends to separate in an arch shape from the circumference of the storage drum and to form a spiral shaped ballooning-configuration downstream into the withdrawal eyelet. This known phenomena of the balloon formation leads to strong mechanical loads in the yarn, to an increasing tension in the withdrawn yarn and to yarn breakages, respectively. These disadvantages are eliminated by suppressing the balloon formation by means of the yarn control element. However, due to its distance from the circumferential surface of the storage drum the yarn control element does not suffice to guarantee a uniform and pre-determined basic tension in the withdrawn yarn. For this reason and as mentioned in GB-1355518 in addition to and upstream of the yarn control element frequently a so called brush braking ring is installed at a bracket fixed to the housing, the bristles of which contact the drum and brake the yarn in order to guarantee the necessary yarn withdrawal tension. However, a brush braking ring has, for mechanical reasons, the disadvantage of a speed-dependent braking effect i.e. a braking effect raising the yarn tension with increasing speed. This is a disadvantage, since the withdrawal tension should remain approximately uniform within a broad speed range in order to achieve optimal insertion relations in the weaving machine.

It is an object of the present invention to create a yarn feeder of the kind as disclosed above in which in a structurally simple way an essentially constant yarn withdrawal tension can be achieved in conjunction with the balloon limiting function. This object can be achieved by providing a yarn control element configured as a finite band having a planar cross section, which band is laid on the cylindrical circumferential section with mutually aligned adjacent ends. The band is resistant against extension in circumferential direction of the storage drum and is yieldable in the radial direction of the storage drum, and an elastic tensioning device is provided which preloads the band against the circumferential section.

The yarn is pulled through between the lower side of the band and the cylindrical circumferential section of the storage drum and in addition orbits in the circumferential direction during its withdrawal movement. The mechanical obstacle of the band suppresses the balloon formation tendency of the yarn extremely effectively. Further, a uniform and precisely pre-determinable braking effect is exerted onto the yarn by the contact pressure of the band against the circumferential portion, which braking effect surprisingly remains constant with yarn speed variations. In this way the balloon formation is suppressed by the yarn control element and simultaneously an essentially constant yarn withdrawal tension is achieved. The yarn has to overcome the elastic pre-load spanning or forcing the band onto the circumferential section only at its passing location below the band which in the circumferential area of the passing location remains supported on the circumferential section. Thanks to the yieldability of the band in the radial direction the yarn is forming so to speak an orbiting wave in the band or a sickle shaped free space, respectively, such that at this deformation the deformation resistance of the band remains essentially constant and independent of the speed. Since the perpendicular force on the yarn resulting from the pre-load of the band against the circumferential section remains essentially constant and is independent of speed, and due to the constant friction coefficients between the yarn and the band and the circumferential section, respectively, the advantageous result is that the yarn withdrawal tension remains essentially constant. The reasons for this positive effect of the yarn control element cannot be judged precisely. However, the result of the co-operation between the yarn, the band and the circumferential section, namely an essentially constant yarn withdrawal tension, is convincing. Unexpectedly even the gap between the ends of the band does not disturb the uniform braking effect, apparently since due to the dynamic movement relations the yarn does not feel the circumferential interruption in the band, provided that the yarn direction is inclined in relation to the direction of the circumferential gap.

Suitably the band is of flexible metal or plastic. Furthermore the use of a compound-band is possible having a wear resistant layer and in connection therewith another layer with differing properties.

The band in one embodiment includes a circumferential interruption so that two terminal ends are formed. The terminal ends of the band are parallel to one another and inclined, and the circumferential interruption in the band is as small as possible. The direction of the ends of the band is selected such that the yarn never will pass across the circumferential interruption with parallel orientation.

The band can be elastically pre-loaded by a tensioning device and is positioned on the circumferential section exclusively by frictional contact. The friction at the circumferential section is used to suppress an axial wandering of the band under the drag of the yarn.

The band can be positioned on the storage drum by means of a circumferentially extending shoulder. In this way bands of random widths can be positioned safely and with low tension for sensitive yarn materials.

In one embodiment, the band together with the tensioning device is supported in a holder and is positioned on the circumferential section by means of the holder. The holder, which is oriented parallel to the axis of the storage drum, is adjustable and is mounted in a bracket which is fixed to the housing and extends along the circumference of the storage drum. Thus, the position of the band is assured by the holder, suitably allowing an adjustment of the band in the longitudinal direction of the storage drum, and the holder also takes up occurring axial forces.

At the yarn entrance side of the band, a circumferentially extending depression is provided in the storage drum circumference, or the cylindrical circumference section is configured to project outwardly beyond the storage drum circumference at the yarn entrance side. In accordance with this embodiment, a significantly gentle yarn entrance below the band is achieved.

The tensioning device is provided with a spring element which at least bridges the circumferential interruption between the ends of the band. The spring element is connected with the band at least locally, and preferably is constructed of a tensioned elastomeric material, rubber strip or a tension spring. In this embodiment, tension is brought into the band exclusively by the spring element which at least bridges the circumferential gap of the band and pulls both ends of the band towards each other and produces in this way radial contact pressure.

In the alternative embodiment, the tension and the contact pressure of the band can be varied by means of a tension adjustment device in order to adapt to different withdrawal conditions or different yarn materials In yet another embodiment the tensioning device is an annular magnet provided in the storage drum. Thus, the band is radially pressed against the circumferential section by magnetic effects.

Alternatively a circumferentially closed tension ring serves to span the band. The tension ring suitably is made from a material which does not produce a significant resistance against the wave shaped deformation of the band due to the influence of the yarn.

In another embodiment, the tensioning ring is open and includes overlapping ends. The tension ring spanning the band uniformly about the circumferential section can thus be adjusted in its length in order to vary the tension.

The tension ring can be made of plastic foam material or rubber, or may be formed as a ring-shaped coil spring. This construction is particularly advantageous since plastic foam material, elastomeric material, or rubber or even a ring-shaped coil spring lead to constant spring properties for long durations, and are contamination-proof. Particularly, homogenous materials have a negligible resistance against the wave motion of the band.

In an alternative embodiment the tension ring is designed as an annular membrane of rubber or elastomeric material.

In yet another alternative embodiment, the tension ring is in the form of a ring body with spokes or teeth. This type of tension ring simultaneously can be used to position the band in the axial direction.

A particularly advantageous embodiment includes a tension ring configured as a hollow, tubular and inflatable ring. The ring tube per se is able to produce a circumferential tension. Depending upon the degree of inflation, the tension or the radial pressure, respectively, can be varied and adjusted precisely, even without a tension adjustment device.

In another embodiment the band is solely fixed by friction, namely with the counter pressure of the storage drum.

In still another alternative embodiment the band at least in sections is connected with the tension ring. This can be of advantage for mounting reasons. In case of foam material, rubber or elastomeric material the connection can be made by in-situ forming, vulcanisation or bonding and for that reason can be made very uniformly such that a completely uniform response behaviour of the band is achieved for the passage of the yarn.

The tension ring can be as broad as the band, in which case a uniform back-up contact is achieved over the width of the band. Since the band already is rigid against bending in lateral direction due to its shape and due to the contact with the storage drum the tension ring may even be made narrower than the band.

In another embodiment the band is supported in the holder via the tension ring or by means of a carrier ring surrounding the tension ring. No special positioning of the band on the storage drum is needed.

In yet another embodiment, the tension adjustment device is provided at the holder or at the carrier ring of the tension ring. The variation of the tension of the band is possible by increasing or reducing the circumferential length of the holder or the carrier ring of the tension ring such that the tension ring can be biased more or less.

BRIEF DESCRIPTION OF THE DRAWINGS

Embodiments of the invention will be described in conjunction with the drawings, in which:

FIG. 1 illustrates a schematic side view of a yarn feeder;

FIG. 1A illustrates a detail variation of the tension ring;

FIG. 2 illustrates a section of a modified embodiment;

FIG. 3 is a plan view of the FIG. 2 embodiment;

FIG. 4 illustrates a detail variation;

FIG. 5 illustrates a detail in a side view seen in the direction of the axis of the storage drum, which detail can be used in the embodiment of FIGS. 2 and 3;

FIGS. 6A, 6B, and 6C illustrate another variation in a section and in views according to the direction of the storage drum axis;

FIGS. 7 and 8 detail variations in sections, similar to FIG. 6A;

FIGS. 9 and 10 illustrate a further detail variation in a section and a side view;

FIG. 11 illustrates a further detail variation in a sectional view; and

FIG. 12 illustrates a further detail variation in schematical illustration.

DETAILED DESCRIPTION

A yarn feeder F in FIG. 1, typically used to feed a weaving machine with a weft yarn, includes in a stationary housing 1 a drive motor M for a driveshaft 2 shown by its axis. A winding on element 3 is connected to driveshaft 2 for co-rotation. On driveshaft 2 co-axially a storage drum T is rotatably supported, and is not allowed to rotate with driveshaft 2. The yarn Y enters housing 1 in FIG. 1 from the left side, is then wound onto a circumferential surface 6 of storage drum T in subsequent windings into a yarn store 4 by the rotating winding on element 3 and finally, is withdrawn overhead of the storage drum by the weaving machine depending on consumption, either directly by means of a not shown insertion device and without using a yarn eyelet, or through a yarn eyelet 10 provided co-axially with the storage drum T on a bracket 9 of housing 1. The circumferential surface 6 of the storage drum forms a yarn storing section 5 and a withdrawal section 7, respectively. Between both sections 5, 7 a circumferentially continuous cylindrical section 8 is provided.

Said circumferential section 8 is surrounded by a yarn control element S with the form of a thin walled band B with a planar cross-section, extending in the circumferential direction. The band B does not form a closed ring but is finite with its ends, 16, 17 facing each other in the region of a gap 18. Said gap 18 may run axially or as shown at 18' obliquely in relation to the axis of storage drum T. Suitably said gap is oriented such that the yarn Y withdrawn from the yarn store 4 during its passage underneath band B passes the gap 18 with an inclined orientation and never parallel to gap 18.

Said band B either consists of metal, a metal alloy or of plastic material, or is a compound band, is resistant against extension in longitudinal direction but flexible such that it can be deformed easily in the radial direction of the storage drum. Said band B surrounds the circumferential section 8 with direct contact and essentially uniform contact pressure which is produced by means of a tensioning device acting on the band B.

In the simplest form (FIG. 4) the tensioning device is a finite strip 30 made of plastic material, e.g. plastic foam material, rubber or elastomeric material, which bridges the circumferential gap 18 and is bonded to the band B in the areas 31, e.g. by gluing, vulcanisation or the like. The band B should be homogenous over its length. A positive connection between the strip 30 and band B might be possible but is not suitable. The length of band B is adapted to the circumferential length of circumferential section 8 such that the ends defining circumferential gap 18 are as close as possible to each other without contacting or overlapping each other. As soon as band B is brought onto circumferential section 8 strip 30 or the tensioning device is under tension by which the band becomes spanned and is pressed with uniform contact pressure onto circumferential section 8.

In the embodiments of FIG. 1 the tensioning device consists of a circumferentially closed tension ring 15 which e.g. consists of plastic foam material, plastic, rubber or elastomeric material. Tension ring 15 is dimensioned such that it at least presses the band in the radial direction against the circumferential section and, preferably, generates a tension in the circumferential direction. The tension ring 15 in FIG. 1 is a foam material ring having essentially the same width as the band. The plastic foam material ring 15 can be surrounded by a closed carrier ring in which the pre-loaded plastic foam material ring 15 is supported.

The band could be positioned on the circumferential section together with its tensioning device solely by friction contact. In FIG. 1 another kind of positioning is selected, since the carrier ring 20 is supported in a ring shaped holder 13 which itself is held by a sleigh 11 mounted in bracket 9. Said sleigh 11 suitably can be shifted by means of a longitudinal adjustment device 12 in order to hold the band B at an axial optimal position were the balloon formation of the yarn Y is considerably suppressed and a uniform braking effect can be achieved.

FIG. 1A illustrates the tension ring 15 as an annular rubber- or elastomeric membrane 19 either only lying on the band B or connected within separate distinct regions (e.g. by vulcanisation). Said membrane 19 is held by a surrounding carrier ring 20 supported by holder 13.

In FIG. 2 another embodiment is indicated in a sectional view. In this embodiment the storage drum is built with axial rods being moveable in relation to another in order to separate the yarn windings in said yarn store 4, such that said rods define the circumferential surface 6 of the storage drum. In withdrawal direction of the yarn downstream of yarn storing section 5 and in front of withdrawal region 7 the cylindrical circumferential section 8 is situated such that it protrudes outwardly relative to circumferential surface 6. At the entrance side of the yarn a circumferentially continuous depression 21, e.g. a conical chamfer, is formed above which the band B with one edge is freely projecting. By said structural measure the yarn Y will find a suitable gradually tapering entrance gap. The tension ring 14 is a rubber- or elastomeric band 23 generating the contact pressure for the band B. In addition according to FIG. 2 a circumferentially continuous shoulder 22 can be provided in the withdrawal direction behind said circumferential section 8 in order to position band B.

In order to allow the tension generated by tension ring 14 to vary, band 23 is designed finite with mutually overlapping ends 25 and 24 according to FIG. 3, such that pointed end 24 engages into bifurcated end 25. As indicated in dotted lines at 28 the ends 24, 25 are connected with each other in order to transmit the tension of the tension ring 14 onto the band B. In region 26 and 27 tension ring 14 is connected with the band, e.g. by gluing points. Several gluing points or areas can be distributed along the circumference. It also is possible to connect the tension ring in its entire surface area with the band. In region 28 where ends 24, 25 are connected with each other, furthermore a tension adjustment device 29 could be provided in order to allow to vary the tension of tension ring 14.

According to FIG. 5 a holder 32 for a tension roll 33 is provided as a tension adjustment device 29. Holder 32 is designed with a curved lower side adapted to the curvature of band B. End 25 is secured to holder 32. End 24 can be tightened or loosened by rotating the tension roll 33 in order to vary the tension of the tension ring 14 or the contact pressure of the band B, respectively. Holder 32 can be provided in a holder similar to holder 13 on bracket 9.

According to FIG. 6A the tension ring 14 (FIG. 1) is as broad as band B. Tension ring 14 can be a plastic foam material ring 15 or the like. In dotted lines a conical entrance inclination 21 is indicated. When forming a plastic foam material ring 15 its inner circumference is measured such that it is suitably somewhat shorter than the circumferential extension of circumferential section 8 such that according to FIG. 6C the ends of band B overlap each other prior to installing the band B at the storage drum. In this overlapping-region a free space 34 can be provided in the plastic foam material ring 15. If then the band B is installed on the circumferential section according to FIG. 6B then said ends will lie opposite to each other and the free space 34 will be enlarged. In this way the tension will be transmitted into the band B or the radial contact force will be generated uniformly, and the band can operate as intended.

In FIG. 6B a modified embodiment of the tension adjustment device 29 is illustrated. The carrier ring 20 of plastic foam material ring 15 is designed with a circumferential interaction in the region of which between two spaced apart flanges an adjustment device is engaging in order to enlarge or reduce the circumferential length of the carrier ring, respectively, and in order to vary the pre-load of the plastic foam material ring. With similar design said tension adjustment device could be integrated into the holder 13 according to FIG. 1.

FIG. 7 shows that the tension ring 14, e.g. a rubber- or plastic foam material ring 15, is narrower than the band B. Suitably carrier ring 20 is provided in order to support tension ring 14. In a case in which the band B with tension ring 14 is to be positioned on circumferential section 8 without external support by means of friction contact or with the help of the shoulder according to FIG. 2, carrier ring 20 also could be omitted.

In FIG. 8 a possible embodiment of tension ring 14 in the form of an annular rubber membrane 19 is indicated which is surrounded by a carrier ring 20 in order to allow to support the band B by means of the tension ring 14 in the not shown holder.

FIGS. 9 and 10 relate to an embodiment in which the tension ring 14 is designed as a ring body 20' having inwardly protruding teeth or spokes 35 engaging at the band B and optionally even connected therewith. Said teeth or spokes 35 are elastic and are inclined in relation to the radial direction on the axis of the storage drum. At 36 connection zones could be provided.

In FIG. 11 tension ring 14 is defined by an annular tube 36 of elastic material, e.g. rubber or an elastomeric material, the inner hollow space of which can be inflated via a valve 37 by a suitable medium, e.g. air, in order to vary the tension of the band B. Tension ring 14 is supported by carrier ring 20. Said tension ring 14 could, occasionally, be connected with band B at location 38. However, it is possible, to position band B in tension ring 14 by friction contact only.

In FIG. 12 band B consisting of metal is pulled against the circumferential section 8 by means of an annular magnet arrangement 39 inside storage drum. The magnet arrangement 39 could consist of several separate magnets 39' positioned in an array. In this case band B is not adjusted in the circumferential direction of circumferential section 8 but is only uniformly pressed on circumferential section 8 by radial magnetic forces.

The band B may have a thickness of about 0.2 mm and a width between 5 and 55 mm and may occasionally have an inner wear proof surface which is treated or coated. However, said band should be flexible enough so as to be deformable radially and only locally by the yarn in order to form a sickle shaped yarn passage opening with the circumferential section of the storage drum.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A yarn feeder including a housing for a drive motor and a drive shaft, a yarn winding element which rotates with said drive shaft, a storage drum defining thereon a cylindrical and circumferentially closed section, and a ring-shaped yarn control element disposed in stationary and surrounding relation to said circumferentially closed section between yarn withdrawal and yarn storage areas of said storage drum, said yarn control element comprising a finite band having a generally planar cross-section, said band lying upon said circumferentially closed section and having a pair of terminal ends disposed in adjacent and opposed relation with one another, said band being resistant to extension in a circumferential direction defined by said storage drum and yieldable in a radial direction relative to an axis defined by said storage drum, and a tensioning device disposed to elastically pre-load said band against said circumferentially closed section.

2. The yarn feeder of claim 1 wherein said band is constructed of a flexible metal or plastic material, said band having a width defined generally parallel to the axis of said storage drum of between about 5 mm and about 55 mm, and a thickness defined transversely relative to the axis of said storage drum of between about 0.1 mm and about 2.0 mm.

3. The yarn feeder of claim 2 wherein said width of said band is between about 8 mm and about 25 mm and said thickness is between about 0.2 mm and about 0.4 mm.

4. The yarn feeder of claim 1 wherein said terminal ends of said band each define an edge therealong, said edges being parallel to one another and transversely oriented relative to a circumferential direction of said band.

5. The yarn feeder of claim 1 wherein said band is elastically pre-loaded against said circumferentially closed section by said tensioning device which positions said band on said closed circumferential section solely through frictional contact therewith.

6. The yarn feeder of claim 1 wherein said storage drum defines thereon a shoulder which borders said circumferentially closed section and positions said band thereon, said shoulder extending continuously about the entire circumference of said storage drum.

7. The yarn feeder of claim 1 including a bracket fixed to said housing and extending circumferentially along said storage drum, said bracket mounting thereon a holder which positions said band and said tensioning device at said closed circumferential section, said holder being positionally adjustable relative to said storage drum in a direction parallel to the axis thereof.

8. The yarn feeder of claim 1 wherein said circumferentially closed section projects radially outwardly beyond said yarn storage area of said storage drum, said storage drum defines therein a circumferentially extending and tapered depression downstream of said yarn storage area which diverges radially outwardly and into said circumferentially closed section, said depression defining a yarn entrance area of said circumferentially closed section into which yarn is received from said yarn storage area.

9. The yarn feeder of claim 8 wherein said band is positioned on said circumferentially closed section such that same is vertically spaced from and overhangs at least a portion of said depression such that yarn from said yarn store is received thereunder, said storage drum defining a shoulder disposed axially adjacent and downstream of said closed circumferential section which positions said band thereon.

10. The yarn feeder of claim 1 wherein said tensioning device includes a biasing member which is connected to said band and bridges a gap defined between said terminal ends thereof to urge said terminal ends towards one another and place said band under tension, said biasing member comprising an elastomeric material, a rubber strip or a spring.

11. The yarn feeder of claim 1 wherein said band is constructed of metal and said tensioning device comprises an annular magnet arrangement disposed within said storage drum which generates radial magnetic forces to uniformly urge said band radially inwardly against said storage drum.

12. The yarn feeder of claim 1 wherein said tensioning device comprises a closed ring-shaped member which lies along an outwardly facing surface of said band.

13. The yarn feeder of claim 12 wherein said ring-shaped member comprises one of a plastic foam material, an elastomeric material, a coil spring and an annular rubber membrane.

14. The yarn feeder of claim 12 wherein said ring-shaped member includes a plurality of resilient spokes which project inwardly for contact with said band, said storage drum having the shape of a cylinder and the axis of said storage drum extends along the center of said cylinder, each said spoke being inclined relative to a radius defined between the axis of said storage drum and a periphery of said closed circumferential section thereof.

15. The yarn feeder of claim 12 wherein said ring-shaped member comprises a hollow tube which is inflatable so as to vary the tension in said band.

16. The yarn feeder of claim 1 including an adjustment device for varying at least one of a circumferential tension of said band and a contact pressure of said band on said closed circumferential section.

17. The yarn feeder of claim 16 wherein said tensioning device comprises a finite ring which lies on an outer surface of said band and has a pair of overlapping ends which are secured to said adjustment device in an adjustable manner.

18. The yarn feeder of claim 17 wherein said adjustment device comprises a main body portion which rotatably mounts a roller thereon and includes a lower side having a concave curvature which substantially follows a convex curvature of said storage drum, one of said ends of said ring being fixed to said main body portion and the other said end being connected to said roller such that rotation of said roller in a first direction increases the tension in said ring and rotation of said roller in a second direction opposite to said first direction decreases tension in said ring.

19. The yarn feeder of claim 1 further including a bracket fixed to said housing and mounting thereon an annular holder, said tensioning device comprising a closed ring-shaped member which lies along an outwardly facing surface of said band, and said ring-shaped member either directly or via a carrier ring being supported on said holder.

20. The yarn feeder of claim 1 wherein said storage drum is stationary, said band is annular in shape and substantially surrounds said closed circumferential section of said storage drum and directly contacts same, said tensioning device being disposed to bridge a gap defined between said terminal ends of said band and bias same towards one another such that upon installation of said band on said closed circumferential section said tensioning device is placed under tension and presses said band against said closed circumferential section with a substantially uniform contact pressure.

* * * * *